US011712097B1

(12) United States Patent
Simon

(10) Patent No.: US 11,712,097 B1
(45) Date of Patent: Aug. 1, 2023

(54) HAIR RINSING SINK ASSEMBLY

(71) Applicant: Brooke Simon, Medford, OR (US)

(72) Inventor: Brooke Simon, Medford, OR (US)

( * ) Notice: Subject to any disclaimer, the term of this patent is extended or adjusted under 35 U.S.C. 154(b) by 0 days.

(21) Appl. No.: 17/676,337

(22) Filed: Feb. 21, 2022

(51) Int. Cl.
*A45D 19/08* (2006.01)
*A45D 44/10* (2006.01)

(52) U.S. Cl.
CPC ..... *A45D 19/08* (2013.01); *A45D 44/10* (2013.01)

(58) Field of Classification Search
CPC ..... A45D 19/04; A45D 19/06; A45D 19/08; A45D 19/10; A45D 19/12; A45D 19/016; A45D 19/16; A45D 44/10; E03C 1/14; E03C 1/18; E03C 1/182; E03C 1/186
USPC ..... 4/515–523
See application file for complete search history.

(56) References Cited

U.S. PATENT DOCUMENTS 1,898,314 A 2/1933 Sandhagen
2,332,904 A * 10/1943 Ellinger ..... A47C 1/10 4/517
3,965,496 A * 6/1976 Grelle ..... A47K 3/024 4/659
4,587,680 A 5/1986 Brugger
5,450,636 A * 9/1995 Graeber ..... A45D 19/06 4/520
5,896,595 A 4/1999 Spencer
6,367,101 B2 4/2002 Shimizu
7,707,663 B1 * 5/2010 Crawford ..... A45D 19/10 4/523
8,839,467 B2 9/2014 Sclafani
10,463,550 B1 11/2019 Shekarchi
11,490,703 B1 * 11/2022 Norcross ..... E03C 1/14
2006/0053545 A1 3/2006 Schulken
2019/0261759 A1 8/2019 Layton

FOREIGN PATENT DOCUMENTS

WO WO2015006851 1/2015

* cited by examiner

*Primary Examiner* — Erin Deery

(57) ABSTRACT

A hair rinsing sink assembly for rinsing the full length of a user's hair includes a sink that is elongated and tapers such that the sink has a conical shape to accommodate the full length of a user's long hair. A plurality of grooves is integrated into the sink and each of the grooves is oriented to extend along a full length of the sink. In this way each of the grooves can accommodate the user's hair to facilitate the user's hair to be separated into a plurality of strands for efficiently rinsing the user's hair. A faucet is removably integrated into the sink for rinsing the user's hair. Moreover, the grooves facilitate the user's hair to be thoroughly rinsed after hair dye, for example, has been applied to the user's hair.

7 Claims, 4 Drawing Sheets

HAIR RINSING SINK ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to rinsing sink devices and more particularly pertains to a new rinsing sink device for rinsing the entire length of a user's hair. The device includes an elongated sink that includes a plurality of grooves that are each integrated into the sink for separating strands the user's hair. The device includes a faucet that is extendable outwardly from the sink for rinsing the user's hair. The prior art discloses a sink with a support hoop for supporting a user's hair during rinsing. The prior art discloses a variety of conical sink basins for rinsing a user's hair. The prior art discloses a sink basin on a wheeled cart for rinsing a bed-ridden patient's hair.

(2) Description of Related Art Including Information Disclosed Under 37 CFR 1.97 and 1.98

The prior art relates to rinsing sink devices including a sink with a sloped and elongated front wall for facilitating a user's hair to extend downwardly along the front wall for rinsing. The prior art discloses a sink with a curved partition being centrally positioned in the sink for imparting rotation into water that is draining from the sink.

BRIEF SUMMARY OF THE INVENTION

An embodiment of the disclosure meets the needs presented above by generally comprising a sink that is elongated and tapers such that the sink has a conical shape to accommodate the full length of a user's long hair. A plurality of grooves is integrated into the sink and each of the grooves is oriented to extend along a full length of the sink. In this way each of the grooves can accommodate the user's hair to facilitate the user's hair to be separated into a plurality of strands for efficiently rinsing the user's hair. A faucet is removably integrated into the sink for rinsing the user's hair. Moreover, the grooves facilitate the user's hair to be thoroughly rinsed after hair dye, for example, has been applied to the user's hair.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
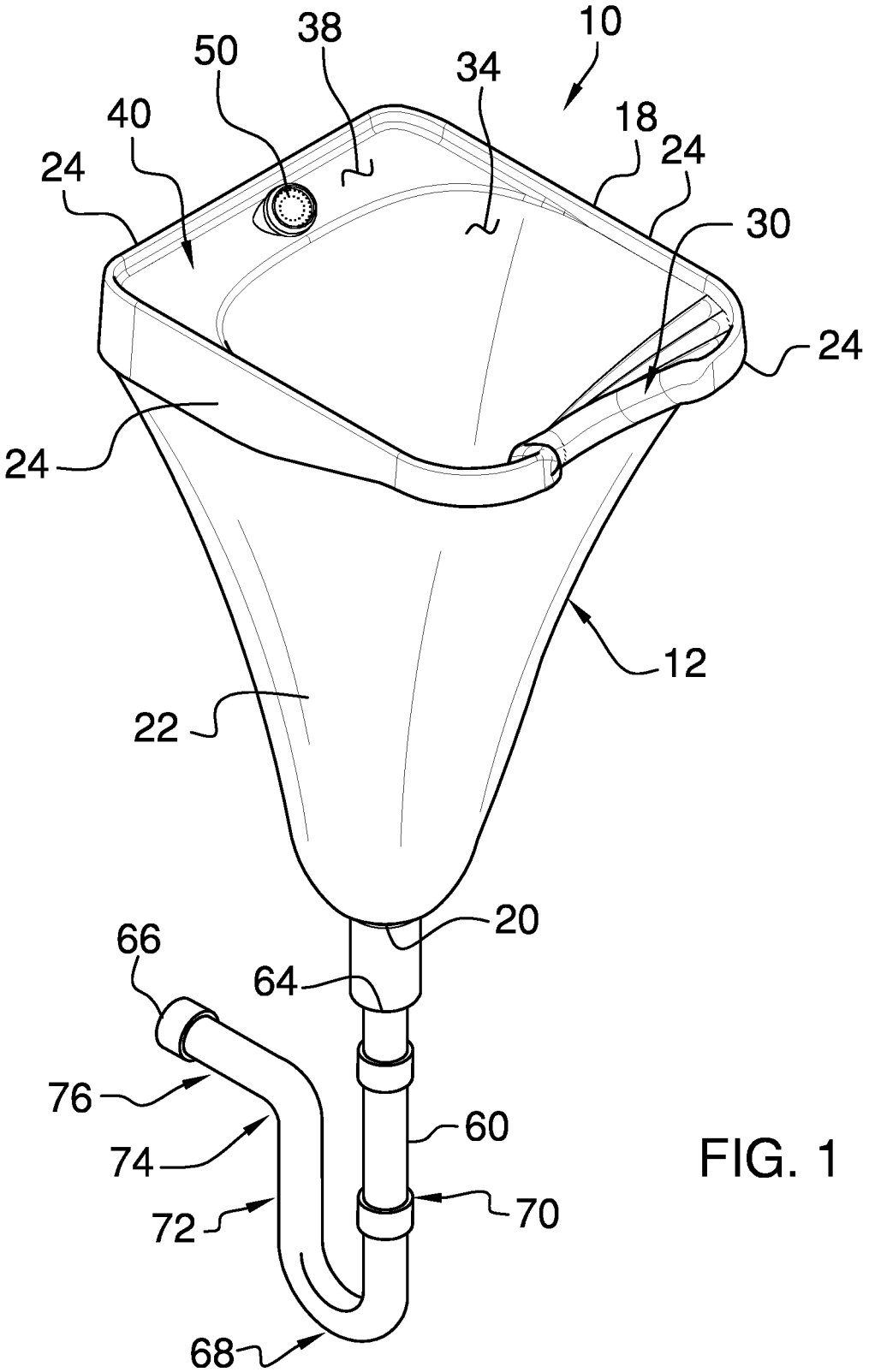
FIG. 1 is a top perspective view of a hair rinsing sink assembly according to an embodiment of the disclosure.
Figure 2:
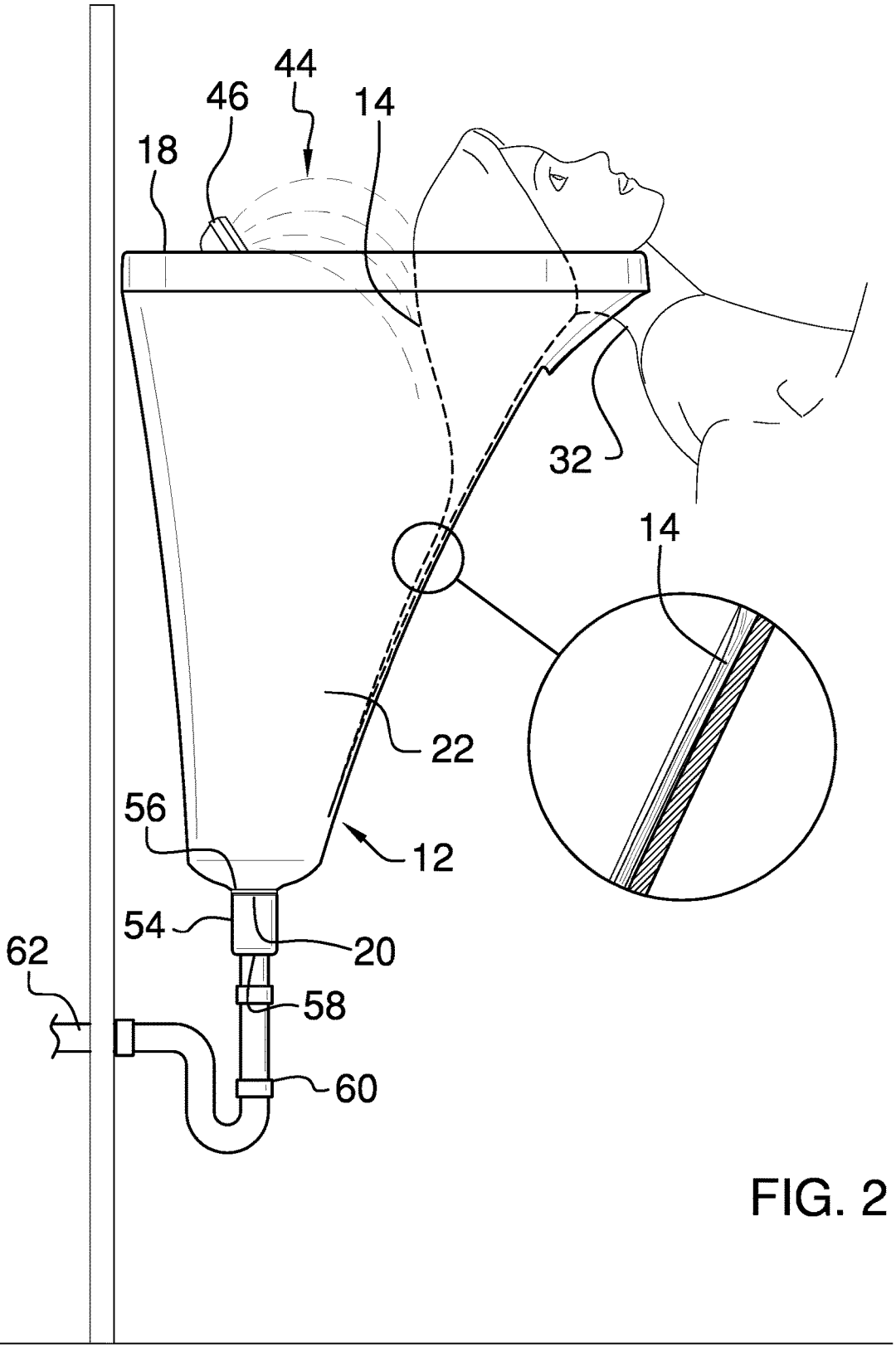
FIG. 2 is a perspective in-use view of an embodiment of the disclosure.
Figure 3:
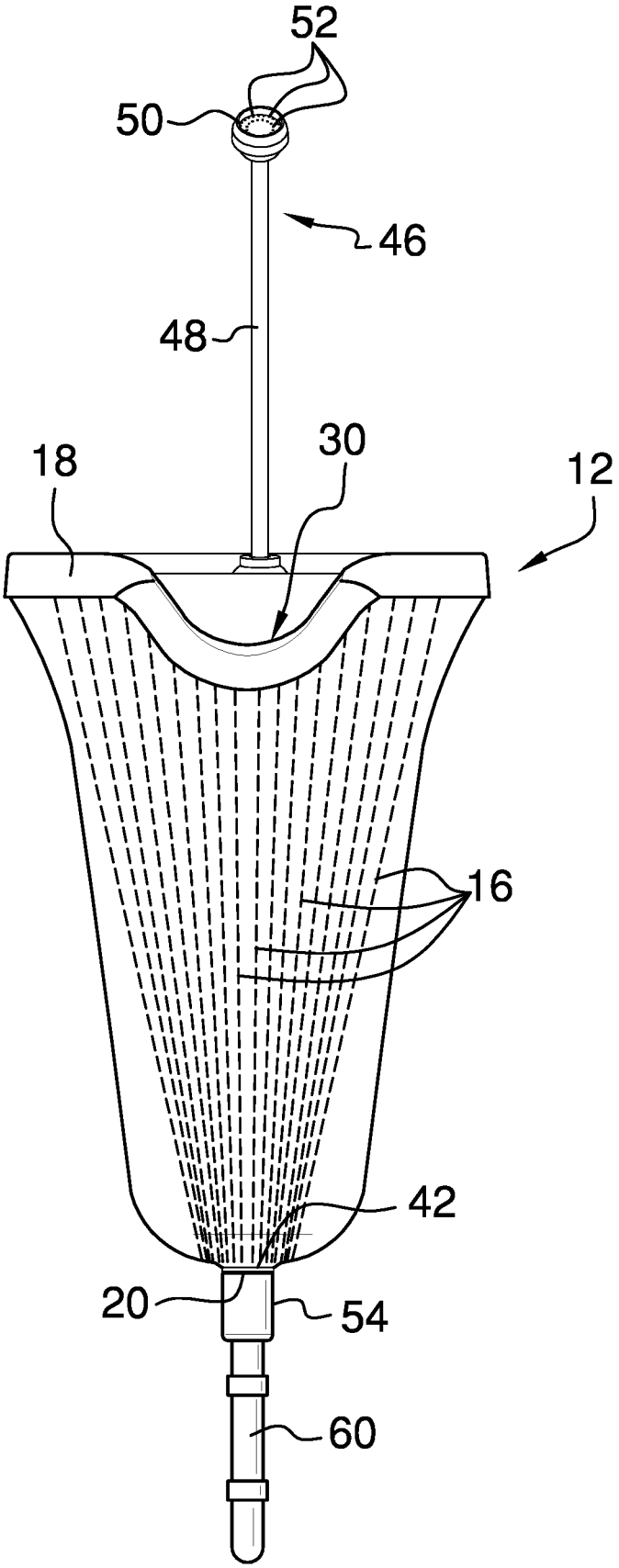
FIG. 3 is a front phantom view of an embodiment of the disclosure.
Figure 4:
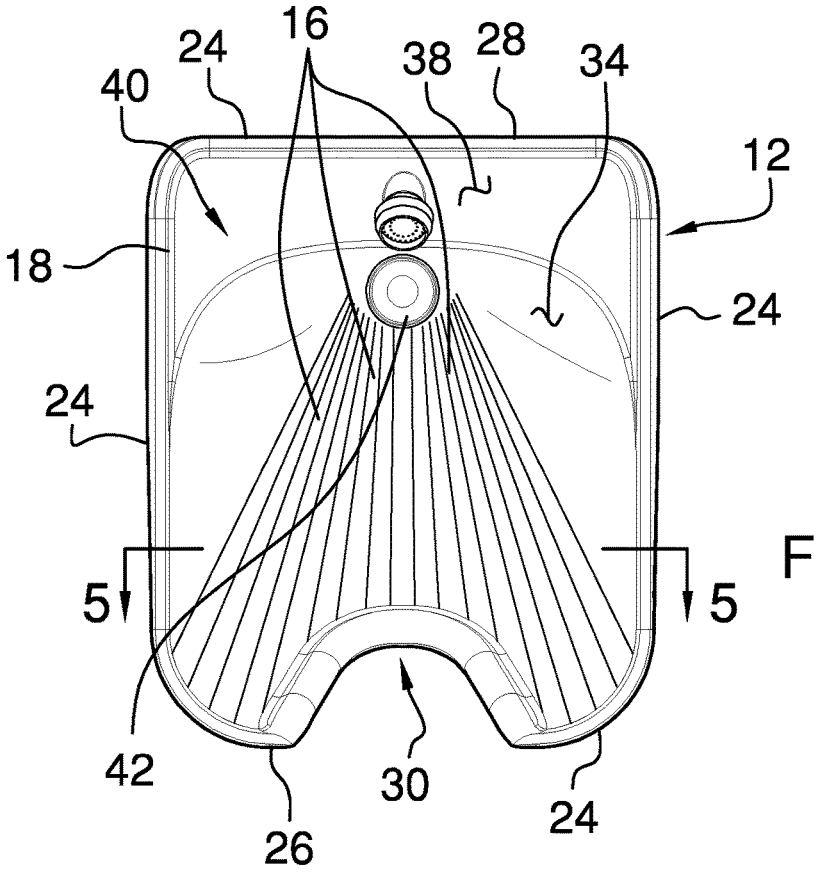
FIG. 4 is a top view of an embodiment of the disclosure.
Figure 5:
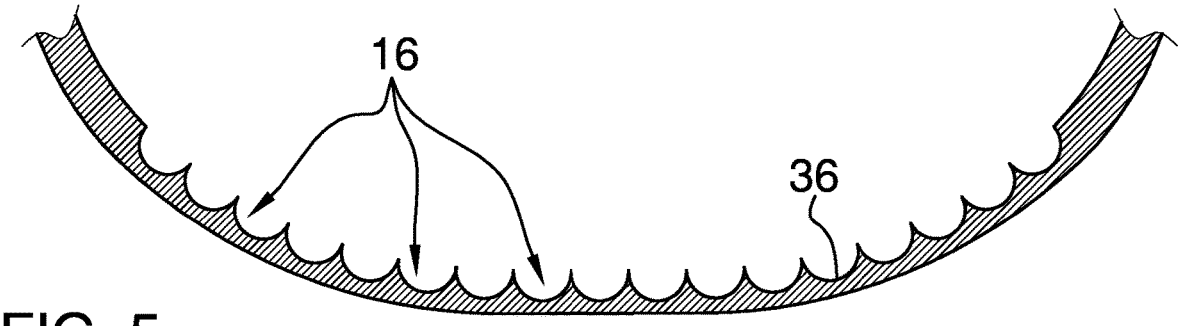
FIG. 5 is a cross sectional view taken along line 5-5 of FIG. 4 of an embodiment of the disclosure.

With reference now to the drawings, and in particular to FIGS. 1 through 5 thereof, a new rinsing sink device embodying the principles and concepts of an embodiment of the disclosure and generally designated by the reference numeral 10 will be described.

As best illustrated in FIGS. 1 through 5, the hair rinsing sink assembly 10 generally comprises a sink 12 is elongated and tapers such that the sink 12 has a conical shape to accommodate the full length of a user's long hair 14. The sink 12 may be positioned in a salon or other location that commonly performs hair dyeing activities. The sink 12 has a plurality of grooves 16 integrated into the sink 12 and each of the grooves 16 is oriented to extend along a full length of the sink 12. In this way each of the grooves 16 can accommodate the user's hair 14 to facilitate the user's hair 14 to be separated into a plurality of strands for efficiently rinsing the user's hair 14.

The sink 12 has a top end 18, a bottom end 20 and an outer wall 22 extending between the top end 18 and the bottom end 20, and each of the top end 18 and the bottom end 20 is open. The outer wall 22 tapers inwardly between the top end 18 and the bottom end 20, and the top end 18 has a plurality of intersecting sides 24 such that the top end 18 has a rectangular shape. The intersecting sides 24 of the top end 18 includes a front side 26 and a back side 28, and the front side 26 has a curved portion 30 which angles downwardly toward the bottom end 20 and rearwardly toward the back side 28. In this way the curved portion 30 can accommodate the user's neck 32 having the user's hair 14 extending into the sink 12. The sink 12 may have a height of at least 30.0 inches and the top end 18 may have a width of at least 19.0 inches.

The outer wall 22 has an inner surface 34 and each of the grooves 16 is integrated into the inner surface 34 of the outer wall 22. Each of the grooves 16 has a bounding surface 36 and the bounding surface 36 of each of the grooves 16 is concavely arcuate with respect to the inner surface 34. The plurality of grooves 16 extends between the front side 26 of the top end 18 and the bottom end 20. Furthermore, the plurality of grooves 16 fans outwardly between the bottom end 20 and the top end 18, and each of the grooves 16 has a decreasing width between the top end 18 and the bottom end 20.

The top end 18 is rounded to enhance comfort for the user when the user lays their neck 32 against the curved portion 30 of the top end 18. The outer wall 22 has a horizontal surface 38 extending between the inner surface 34 and the back side 28 of the intersecting sides 24 of the top end 18 such that the horizontal surface 38 defines a shelf 40. Additionally, a drain 42 is integrated into the bottom end 20 to drain a fluid 44 outwardly from the sink 12. The outer wall 22 slopes outwardly between the front side 26 of the top end 18 and the bottom end 20 at incline that is less than that of a slope of the outer wall 22 between the back side 28 of the top end 18 and the bottom end 20.

A faucet 46 is removably integrated into the sink 12 and the faucet 46 can be fluidly coupled to fluid source 48 for rinsing the user's hair 14. The faucet 46 is positioned on the horizontal surface 38 of the outer wall 22 of the sink 12 and the faucet 46 includes a hose 48 and a head 50 that is fluidly coupled to the hose 48. The hose 48 is extendable upwardly from the horizontal surface 38 having the head 50 being directed into the sink 12 to direct a fluid 44 onto the user's hair 14 for rinsing the user's hair 14. Additionally, the head 50 of the faucet 46 may include a plurality of water jets 52 to produce a shower of the fluid 44 to enhance rinsing the user's hair 14.

A hair trap 54 is fluidly integrated into the sink 12 to capture hair 14 that is rinsed out of the sink 12. The hair trap 54 has an inlet 56 and an outlet 58, and the inlet 56 is coupled to the bottom end 20 of the sink 12 to facilitate the fluid 44 to pass through the hair trap 54. A P-trap 60 is fluidly coupled to the hair trap 54 and the P-trap 60 is fluidly coupled to a sewer system 62 thereby facilitating the fluid 44 in the sink 12 to drain 42 into the sewer system 62. The P-trap 60 has an intake 64 and an exhaust 66, and the intake 64 is fluidly coupled to the outlet 58 of the hair trap 54 such that the exhaust 66 can be fluidly coupled to the sewer system 62.

The P-trap 60 has a first bend 68 that is integrated into the P-trap 60 to define a first portion 70 of the P-trap 60 which is oriented parallel to a second portion 72 of the P-trap 60. In this way the first bend 68 can trap debris passing through the P-trap 60. The P-trap 60 has a second bend 74 that is integrated into the P-trap 60 to define a third portion 76 which is oriented perpendicular to the second portion 72. The intake 64 is associated with the first portion 70 and the exhaust 66 is associated with the third portion 76.

In use, the user lays their neck 32 on the curved portion 30 of the front side 26 of the top end 18 of the sink 12. The user's hair 14 is laid into the plurality of grooves 16 such that the hair 14 is divided into a plurality of strands 76. In this way the user's hair 14 can be thoroughly rinsed of hair dye or other treatments that may have been applied to the user's hair 14. Additionally, dyed portions of the user's hair 14 can be sequestered from un-dyed portions of the user's hair 14 in the grooves 16. In this way the un-dyed portions of the user's hair 14 are protected from coming into contact with the dye that is being rinsed from the dyed portions of the user's hair 14. Thus, the overall quality and appearance of the user's hair 14 can be improved with respect to hair dye and other treatments.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A hair rinsing sink assembly for rinsing hair that has been treated in a salon environment, said assembly comprising:

a sink being elongated and tapering such that said sink has a conical shape wherein said sink is configured to accommodate the full length of a user's hair, said sink having a plurality of grooves being integrated into said sink, each of said grooves being oriented to extend along a full length of said sink wherein each of said grooves is configured to accommodate the user's hair to facilitate the user's hair to be separated into a plurality of strands for rinsing the user's hair;

a faucet being extendably integrated into said sink wherein said faucet is configured to be fluidly coupled to a fluid source for rinsing the user's hair;

a hair trap being fluidly integrated into said sink wherein said hair trap is configured to capture hair that is rinsed out of said sink; and a P-trap being fluidly coupled to said hair trap wherein said P-trap is configured to be fluidly coupled to a sewer system thereby facilitating fluid in said sink to drain into the sewer system;

wherein said sink has a top end, a bottom end and an outer wall extending between said top end and said bottom end, each of said top end and said bottom end being open, said outer wall tapering inwardly between said top end and said bottom end, said top end having a plurality of intersecting sides such that said top end has a rectangular shape, said intersecting sides of said top end including a front side and a back side, said front side having a curved portion which angles downwardly toward said bottom end and rearwardly toward said back side wherein said curved portion is configured to accommodate the user's neck having the user's hair extending into said sink, said bottom end having a drain being integrated into said bottom end wherein said drain is configured to drain fluid outwardly from said sink; and wherein said outer wall has an inner surface, each of said grooves being integrated into said inner surface of said outer wall, each of said grooves having a bounding surface, said bounding surface of each of said grooves being concavely arcuate with respect to said inner surface, said plurality of grooves extending between said front side of said top end and said bottom end, said plurality of grooves fanning outwardly between said bottom end and said top end, each of said grooves having a decreasing width between said top end and said bottom end.

2. The assembly according to claim 1, wherein said top end is rounded to enhance comfort for the user when the user lays their neck against said curved portion of said top end.

3. The assembly according to claim 1, wherein said outer wall has a horizontal surface extending between said inner surface and said back side of said intersecting sides of said top end such that said horizontal surface defines a shelf.

4. The assembly according to claim 3, wherein said faucet is positioned on said horizontal surface of said outer wall of said sink, said faucet including a hose and a head being fluidly coupled to said hose, said hose being extendable upwardly from said horizontal surface having said head being directed into said sink wherein said head is configured to direct fluid from the fluid source onto the user's hair for rinsing the user's hair.

5. The assembly according to claim 1, wherein said hair trap has an inlet and an outlet, said inlet being coupled to said bottom end of said sink wherein said hair trap is configured to facilitate fluid to pass through said hair trap.

6. The assembly according to claim 5, wherein said P-trap has an intake and an exhaust, said intake being fluidly coupled to said outlet of said hair trap wherein said exhaust is configured to be fluidly coupled to the sewer system, said P-trap having a first bend to define a first portion of said P-trap being oriented parallel to a second portion of said P-trap wherein said first bend is configured to trap debris passing through said P-trap, said P-trap having a second bend to define a third portion being oriented perpendicular to said second portion, said intake being associated with said first portion, said exhaust being associated with said third portion.

7. A hair rinsing sink assembly for rinsing hair that has been treated in a salon environment, said assembly comprising:

a sink being elongated and tapering such that said sink has a conical shape wherein said sink is configured to accommodate the full length of a user's hair, said sink having a plurality of grooves being integrated into said sink, each of said grooves being oriented to extend along a full length of said sink wherein each of said grooves is configured to accommodate the user's hair to facilitate the user's hair to be separated into a plurality of strands for rinsing the user's hair, said sink having a top end, a bottom end and an outer wall extending between said top end and said bottom end, each of said top end and said bottom end being open, said outer wall tapering inwardly between said top end and said bottom end, said top end having a plurality of intersecting sides such that said top end has a rectangular shape, said outer wall having an inner surface, said intersecting sides of said top end including a front side and a back side, said front side having a curved portion which angles downwardly toward said bottom end and rearwardly toward said back side wherein said curved portion is configured to accommodate the user's neck having the user's hair extending into said sink, each of said grooves being integrated into said inner surface of said outer wall, each of said grooves having a bounding surface, said bounding surface of each of said grooves being concavely arcuate with respect to said inner surface, said plurality of grooves extending between said front side of said top end and said bottom end, said plurality of grooves fanning outwardly between said bottom end and said top end, each of said grooves having a decreasing width between said top end and said bottom end, said top end being rounded to enhance comfort for the user when the user lies their neck against said curved portion of said top end, said outer wall having a horizontal surface extending between said inner surface and said back side of said intersecting sides of said top end such that said horizontal surface defines a shelf, said bottom end having a drain being integrated into said bottom end wherein said drain is configured to drain fluid outwardly from said sink;

a faucet being extendably integrated into said sink wherein said faucet is configured to be fluidly coupled to a fluid source for rinsing the user's hair, said faucet being positioned on said horizontal surface of said outer wall of said sink, said faucet including a hose and a head being fluidly coupled to said hose, said hose being extendable upwardly from said horizontal surface having said head being directed into said sink wherein said head is configured to direct fluid from the fluid source onto the user's hair for rinsing the user's hair;

a hair trap being fluidly integrated into said sink wherein said hair trap is configured to capture hair that is rinsed out of said sink, said hair trap having an inlet and an outlet, said inlet being coupled to said bottom end of said sink wherein said hair trap is configured to facilitate fluid to pass through said hair trap; and a P-trap being fluidly coupled to said hair trap wherein said P-trap is configured to be fluidly coupled to a sewer system thereby facilitating fluid in said sink to drain into the sewer system, said P-trap having an intake and an exhaust, said intake being fluidly coupled to said outlet of said hair trap wherein said exhaust is configured to be fluidly coupled to the sewer system, said P-trap having a first bend to define a first portion of said P-trap being oriented parallel to a second portion of said P-trap wherein said first bend is configured to trap debris passing through said P-trap, said P-trap having a second bend to define a third portion being oriented perpendicular to said second portion, said intake being associated with said first portion, said exhaust being associated with said third portion.

* * * * *